United States Patent [19]

Bredel et al.

[11] Patent Number: 4,493,979

[45] Date of Patent: Jan. 15, 1985

[54] CONTROL CIRCUIT ASSEMBLY FOR HEATING ELEMENTS IN COOKING PLATES

[75] Inventors: Walter Bredel; Norbert Schenetin, both of Traunreut; Helmut Waigand, St. Georgen, all of Fed. Rep. of Germany

[73] Assignee: Bosch-Siemens Hausgeraete GmbH, Stuttgart, Fed. Rep. of Germany

[21] Appl. No.: 465,055

[22] Filed: Feb. 9, 1983

[30] Foreign Application Priority Data

Feb. 10, 1982 [DE] Fed. Rep. of Germany ..... 3204598

[51] Int. Cl.[3] ..... H05B 3/68

[52] U.S. Cl. ..... 219/446; 219/449; 219/452; 219/463; 219/466; 219/480

[58] Field of Search ..... 219/218, 443, 444, 445, 219/446, 447, 449, 451, 452, 464, 463, 466, 467, 480, 499, 509, 476; 310/83, 112, 113; 318/7, 151, 147, 148

[56] References Cited

U.S. PATENT DOCUMENTS

| | | | |
|---|---|---|---|
| 2,419,399 | 4/1947 | Myers | 219/446 |
| 2,450,399 | 9/1948 | Sheidler | 219/446 |
| 4,158,127 | 6/1979 | Husslein | 219/446 |
| 4,313,052 | 1/1982 | Fischer | 219/446 |
| 4,394,564 | 7/1983 | Dills | 219/449 |

FOREIGN PATENT DOCUMENTS 3004187 8/1980 Fed. Rep. of Germany .

*Primary Examiner*—Volodymyr Y. Mayewsky

*Attorney, Agent, or Firm*—Herbert L. Lerner; Laurence A. Greenberg

[57] ABSTRACT

A control circuit assembly, includes a cooking plate having at least two individual cooking regions being electrically connectible in common for cooking together, heating elements being disposed in the cooking regions of the cooking plate and having inputs, current circuits connected to the heating elements, an electronic control device connected to the inputs of the heating elements for producing variable heating power outputs, heating power control devices respectively associated with the heating elements, and switching elements disposed in the current circuits for selectively connecting each of the respective heating elements in the individual cooking regions to one of the heating power control devices in a first switching mode, and for connecting the heating elements of the individual cooking regions together to one of the heating power control devices while disconnecting the other heating power control devices from the respective heating elements with which they are associated in a second switching mode.

12 Claims, 8 Drawing Figures

CONTROL CIRCUIT ASSEMBLY FOR HEATING ELEMENTS IN COOKING PLATES

The invention relates to a control circuit assembly for heating elements in cooking plates with at least two individual cooking regions, each having input means for an electronic control device for producing variable heating powers, the individual cooking regions being useable together by electrically connecting them together, especially for use with elongated cooking pans.

It is common practice with cooking plates to provide a number of cooking regions, each having a heating element acting in one heating region as a rule. For different pot sizes, cooking regions with different areas are provided. It is also known to provide cooking regions having an elongated or oval shape with correspondingly shaped heating elements for specially shaped cooking pots, such as for pans for fish or fowl, having an elongated or oval shape. Preferably, there is also an additional heating zone connected to a central heating region, such as is described in German Published, Non-Prosecuted Application DE-OS No. 30 04187.

Obviously, it is also possible to use two adjacent individual cooking regions at the same time for a cooking pan extending over both cooking regions, in which case the heating power control is effected individually for both cooking regions. However, with this type of operation, a disadvantage is that there is an unheated area between the two individual cooking regions. A known solution to this problem is to provide an additional heating element between the individual cooking regions, so that an elongated cooking region is formed by the two individual cooking regions and the additional heating region between them. This is described in German Patent DE-PS No. 26 53 389. It has already been suggested, to connect together the individual heating regions used simultaneously, and to control them together for obtaining a correspondingly dimensioned heating power output.

It is accordingly an object of the invention to provide a control circuit assembly for heating elements in cooking plates, which overcomes the hereinafore-mentioned disadvantages of the heretoforeknown devices of this general type, and to provide an apparatus for controlling the heating elements during the individual use of the cooking regions as well as during the combined use of the cooking regions, firstly in order to permit manufacture at a low cost, and secondly to assure a reliable failure-free operation and use. The control device according to the invention is based on switching operations using electronic switching elements, wherein the input of the heating power-control criteria is chosen by rotary switches or push keys, such as touch-sensitive switches. The indication (of the operating mode) is correspondingly effected either by the respective position of the input switches, by mechanical indicating means, or by electronically controlled electronic displays.

With the foregoing and other objects in view there is provided, in accordance with the invention, a control circuit assembly, especially for use with elongated cooking pans, comprising a cooking plate having at least two individual cooking regions being electrically connectible in common for for cooking together, heating elements being disposed in the cooking regions of the cooking plate and having inputs, current circuits connected to the heating elements, an electronic control device connected to the inputs of the heating elements for producing variable heating power outputs, heating power control devices respectively associated with the heating elements, and switching elements disposed in the current circuits for selectively connecting each of the respective heating elements in the individual cooking regions to one of the heating power control devices in a first switching mode, or for connecting the heating elements of the individual cooking regions together to one of the heating power control devices while disconnecting the other heating power control devices from the respective heating elements with which they are associated in a second combined switching mode.

An apparatus constructed according to these inventive features has important advantages for cooking plates, in terms of their manufacture as well as with respect to operating technique. It is only necessary to place one additional on-off element in the operating panel of the cooking plate besides the input and indicating elements assigned for the individual cooking regions. Only switching operations having to do with the circuit are used. Additional measures for the combination mode of operation of individually controlled heating regions are therefore not required. This also has advantageous results with respect to the operation of the cooking plate. Normally, all sequentially disposed individual cooking regions are operated together in the combination mode. For the person operating the range, it makes sense to operate that control element for the individual heating current control which is assigned to the forward cooking region lying nearest to the operator. For switching to the combination operating mode, only a single input element is operated at the beginning, and the fact that the combination mode is turned on, is indicated either by the position of the input element, or preferably by a light-signal or a display. The apparatus according to the invention also ensures that the effect of the two heating power control devices on the heating elements to which they are assigned during the individual cooking mode is reliably interrupted. An operating error therefore becomes impossible.

A control circuit assembly for the control of the cooking regions in cooking plates, wherein at least one additional cooking region is disposed between two individual cooking regions, is also a feature of the invention. Therefore, in accordance with another feature of the invention, the cooking plate includes an intermediate cooking region disposed between the individual cooking regions, one of the heating elements is disposed in the intermediate cooking regions, and in the second switching mode when the heating elements of the individual cooking regions are connected together to the one heating power control device, the heating element of the intermediate cooking region is exclusively connected to a single one of the heating power control devices. With such a device, by connecting the switching elements in one of their switching positions, this additional heating region is connected to one of the heating power control devices. In this way, an essentially continuous heating region is uniformly supplied with the selected, required energy by the already existing heating power control device.

It is known and conventional practice in cooking plates to provide individual cooking regions with different sizes, i.e. with different diameters; it may serve this purpose to use the same type of heating elements which are suited to the size of the smaller cooking regions, and to provide an additional heating element for the larger heating regions, such as in the form of a ring which is added to the individual heating element. However, it is disadvantageous to combine individual cooking regions of different sizes, which are individually controlled, to be used by themselves, because in this case different amounts of heating power act on the food to be cooked in the different regions.

In accordance with a further feature of the invention, at least one of the cooking regions of the cooking plate is in the form of a central heating zone having one of the heating elements disposed therein and a rim heating zone having another of the heating elements disposed therein, the one and other heating elements are controllable together by one of the heating power control devices, and in the second switching mode of the preset switching element, the heating element of the rim heating zone is disconnected from the heating power supply. In this connection, provisions are also made for preventing this additional heating element from being activated by the heating power control device used during the individual operation together with the central zone heating element, during the time that the central zone heating element is switched to the combined heating mode.

In accordance with an added feature of the invention, there are provided individual switching contacts respectively associated with and disposed in series with the heating elements, sensors being connected to the switching contacts and disposed at the heating elements for limiting temperature of the heating elements, the switching contacts being connected in series with the heating elements associated therewith in the second switching mode. Due to this preferred embodiment, no additional measures are required to prevent overheating within the frame of the invention; the temperature sensors and switches are utilized with the same function and effective zones in the individual control and operating mode, as during the combined operating mode.

In accordance with an additional feature of the invention for cooking regions with heating elements without a temperature limiter of their own, (such a device is often omitted in the intermediate heating elements), in the switching modes when given heating elements having no temperature limiting means of their own are connected to the heating power control devices, the given heating elements are connected to switching elements associated with other heating elements for temperature limiting.

With respect to the use of electronic switching circuits for the control of the heating elements in cooking plates, in accordance with again another feature of the invention, the heating power control devices are in the form of power activation control input elements for the individual cooking regions, and there is provided an input element connected to the electronic control device for combined control of a plurality of heating elements, and respective power switch connected upstream of each of the heating elements, the electronic control device being in the form of a logic circuit connection connected between the control input elements and power switches, for connecting the power switches to a predetermined one of the control input elements and disconnecting the others of the control input elements in the second switching mode, when the input element is operated. This measure has the positive effect of ensuring that the respective power amplifier which controls the heating power for the individual heating elements of the cooking regions in the individual operation, is also fully used in the combination mode, and that there is no need for an additional heat power switch, which in this case would have to switch the full load. In this case, it is also not necessary to make one of the heating power switches capable of carrying the increased load during combined operation. The electronic circuit construction is limited to simple digital switching.

In accordance with again a further feature of the invention, the logic circuit connection is a microprocessor circuit or interface circuit having inputs and at least one parallel output terminal, and there is provided a multiplexing circuit being controlled by the microprocessor and connecting together the control input elements for the individual cooking regions to at least one of the inputs of the microprocessor, the input element being connected to one of the inputs of the microprocessor, and switching amplifiers connected between the power switches and the at least one parallel output terminal of the microprocessor. A variation of this construction is also possible, wherein, in accordance with again an added feature of the invention, the at least one input of the microprocessor is an analog input, and the control input elements connected to the at least one input are mechanical switches having voltage dividing circuits in the form of ohmic resistors.

This makes it possible to use rotary switches, the operation of which corresponds to the operation of conventional heat input regulators.

In accordance with again an additional feature of the invention, the control input elements are touch-sensitive switching units disposed in pairs for each of the heating power control inputs of the individual cooking regions, the microprocessor includes digital inputs assigned to opposing functions, and the switching unit pairs are connected in parallel to the digital inputs of the microprocessor. This feature is very advantageous in the application of electronic digital circuitry for the control processes, because touch-sensitive switches for the input of such control functions are more economical, and furthermore require less maintenance and are easier to operate.

In accordance with yet another feature of the invention, there are provided indicating displays connected to the parallel outputs of the microprocessor, and storing gate circuits being controlled by the microprocessor and each being respectively associated with one of the switching amplifiers connected to the power switches. Each storing gate circuit is connected between the outputs of the microprocessor on one hand, and the indicating displays and the switching amplifiers which control the power switching devices, on the other hand.

In accordance with yet a further feature of the invention, there is provided a blinker unit for controlling the indicating display, the blinker unit being assigned to the control input element which is disconnected from the heating elements during the second switching mode, and a storage stage being connected to the circuit assembly when the blinker unit is activated, the storage stage being reset by a corresponding switching input in an off position of the power-turn-off or deactivation control input element which is disconnected in the second switching mode. The blinker unit is activated during the operation of the input element for combined control of several heating elements, and during the superimposed operation of the disconnected power control input element.

With respect to the operating reliability, it is advantageous for the storage stage to be connected to the blinker unit for control of the indicating display which is assigned to the power control device that is disconnected from its associated heating region during the combined operating mode.

In accordance with a concomitant feature of the invention, there is provided a blinker unit for controlling the indicating display, the blinker unit being assigned to the control unit element which is disconnected from the heating elements during the second switching mode, and a storage stage being connected to the circuit assembly when the blinker unit is activated, the storage stage being reset by a corresponding switching input after the end of the second switching mode.

Other features which are considered as characteristic for the invention are set forth in the appended claims.

Although the invention is illustrated and described herein as embodied in a control circuit assembly for heating elements in cooking plates, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings, in which.

Figure 1:
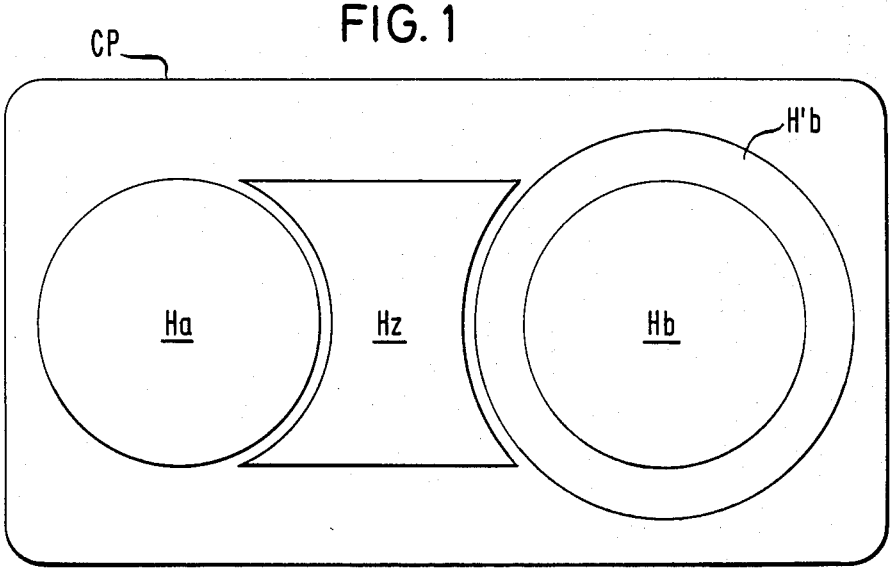
FIGS. 1–4 are similar diagrammatic top plan views of possible operating modes using two individual cooking regions and an intermediate cooking region combined in a cooking plate of a range, the shaded areas indicating the operating state.
Figure 2:
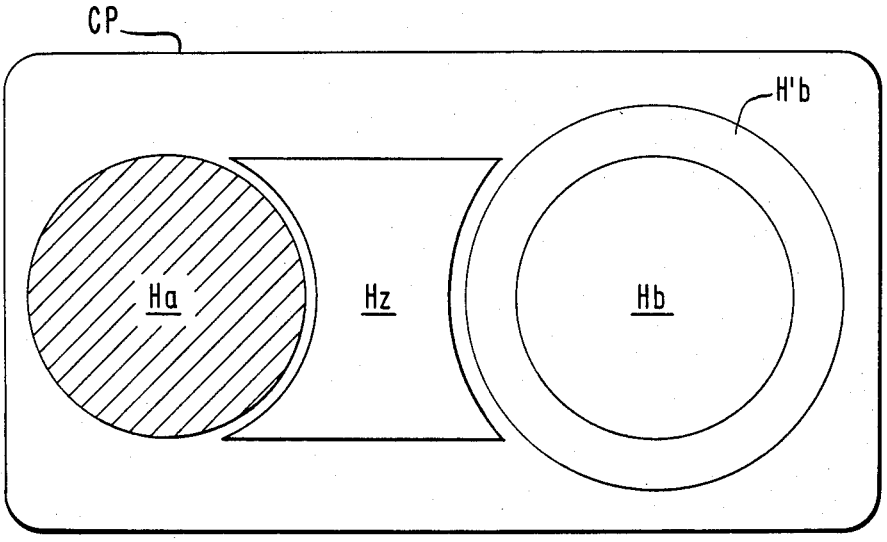
Figure 3:
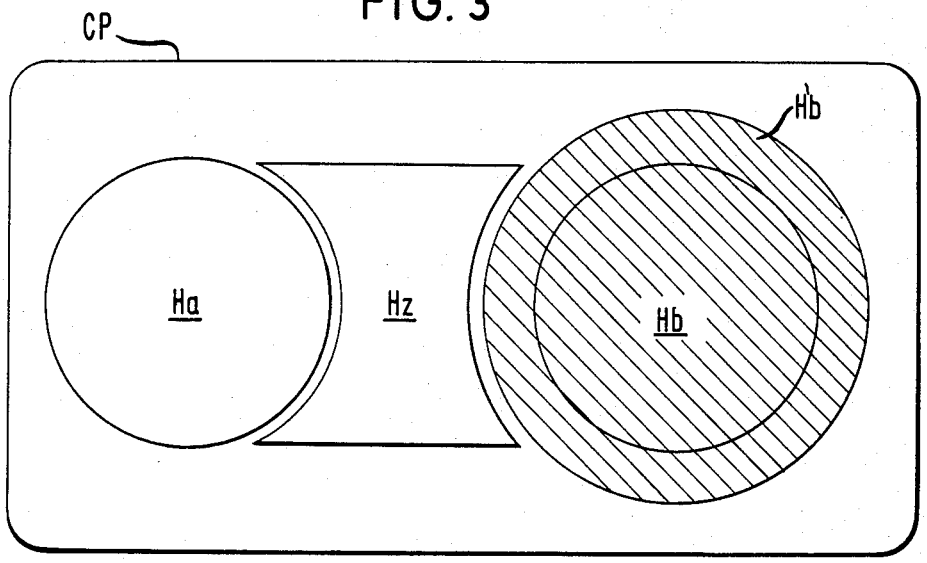

Referring now to the figures of the drawing and first particularly to FIGS. 1–4 thereof, there is seen a first individual cooking region Ha, a second individual cooking region divided into two zones Hb and H'b for heating which is technically separated from each other, and an intermediate cooking region Hz disposed between these individual cooking regions. The circuit configuration according to the invention should make it possible to control either one of the two heating regions Ha or Hb and H'b individually alone, or individually together. The shaded area of the heating area Ha in FIG. 2 designates its operating state, while the shaded area in FIG. 3 shows the operating state of the heating region formed by a circular inner heating zone Hb and an outer annular heating zone H'b around it. Both heating zones are controlled by a common control element and function together during an individual heating mode.

Figure 4:
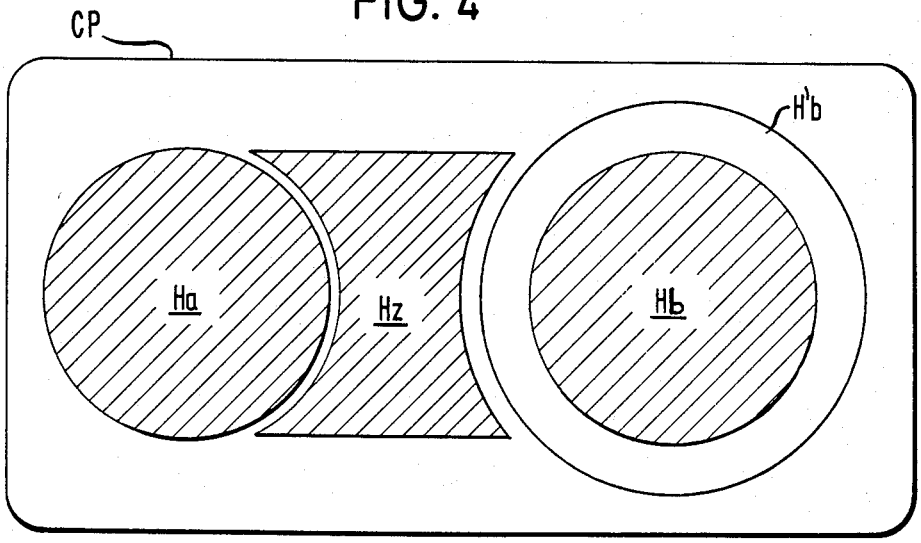

FIG. 4 shows a combination heating mode. In this case the heating region Ha, the inner heating zone Hb and the intermediate heating zone Hz lying therebetween are in operation. The ring-shaped heating region H'b which surrounds the heating region Hb is turned off. This provides an elongated essentially homogenous heating area for elongated or oval cooking or frying utensils.

Normally, four individual cooking regions are disposed on a cooking plate, of which two individual cooking regions with an intermediate cooking region therebetween can be connected for combined operation. However, it is also possible to provide two pairs of individual cooking regions each on a cooking plate CP shown in FIG. 1, with or without intermediate cooking zones, or other suitable configurations may be devised.

Figure 5:
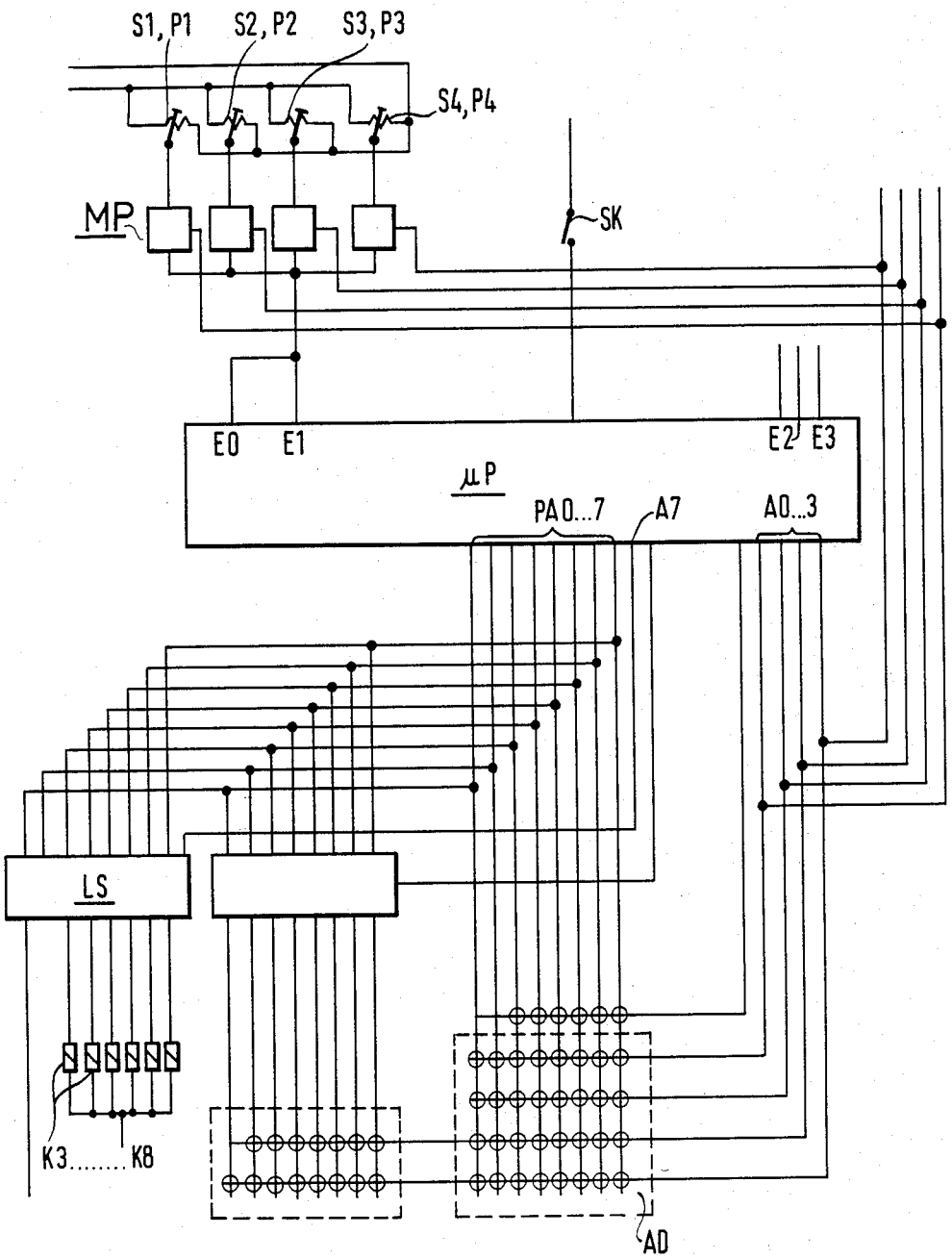
FIG. 5 is an overall schematic circuit diagram of a control device including a microprocessor.
Figure 6:
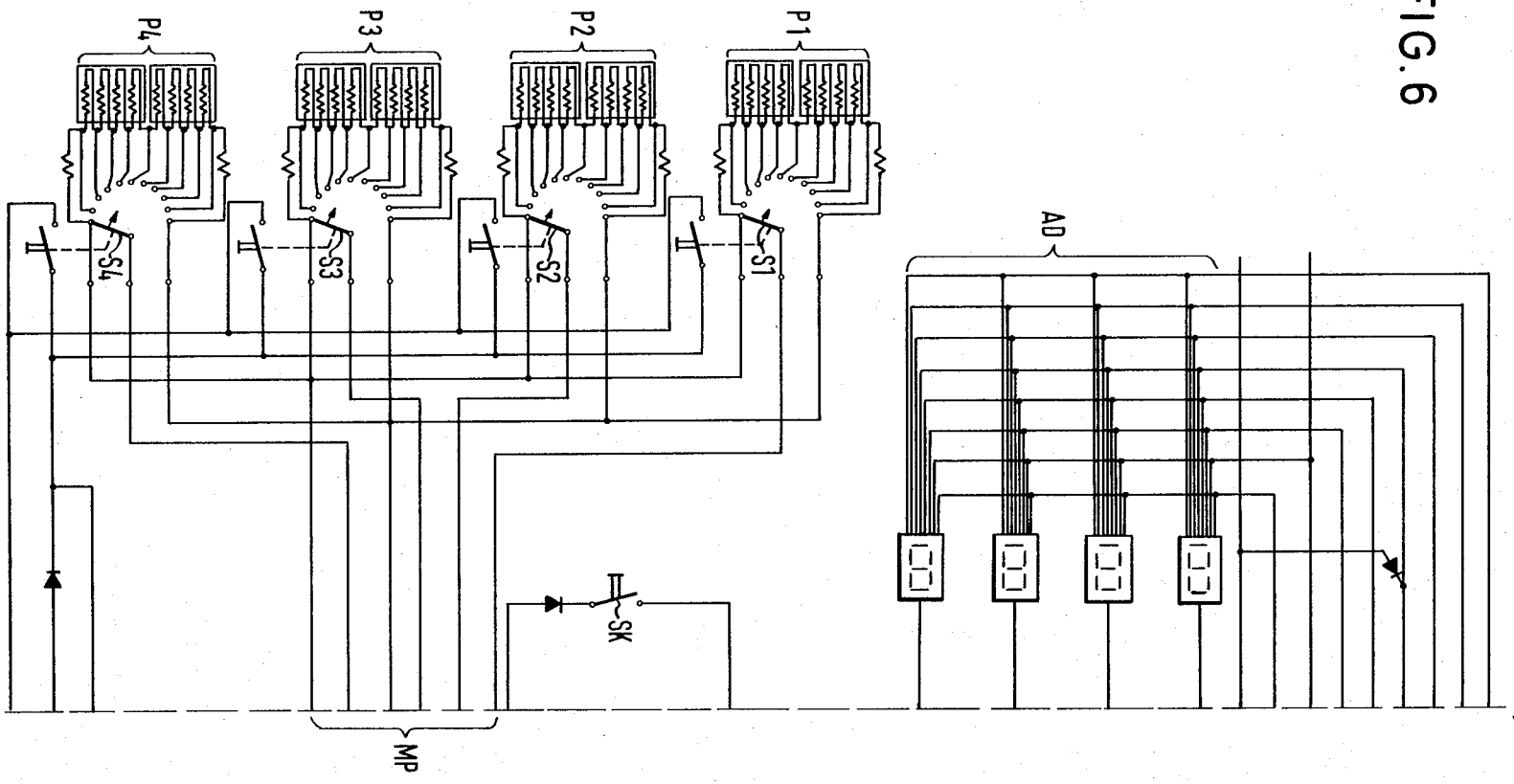
FIG. 6 is a circuit diagram of a part of a switching circuit configuration in vicinity of the input elements.
Figure 7:
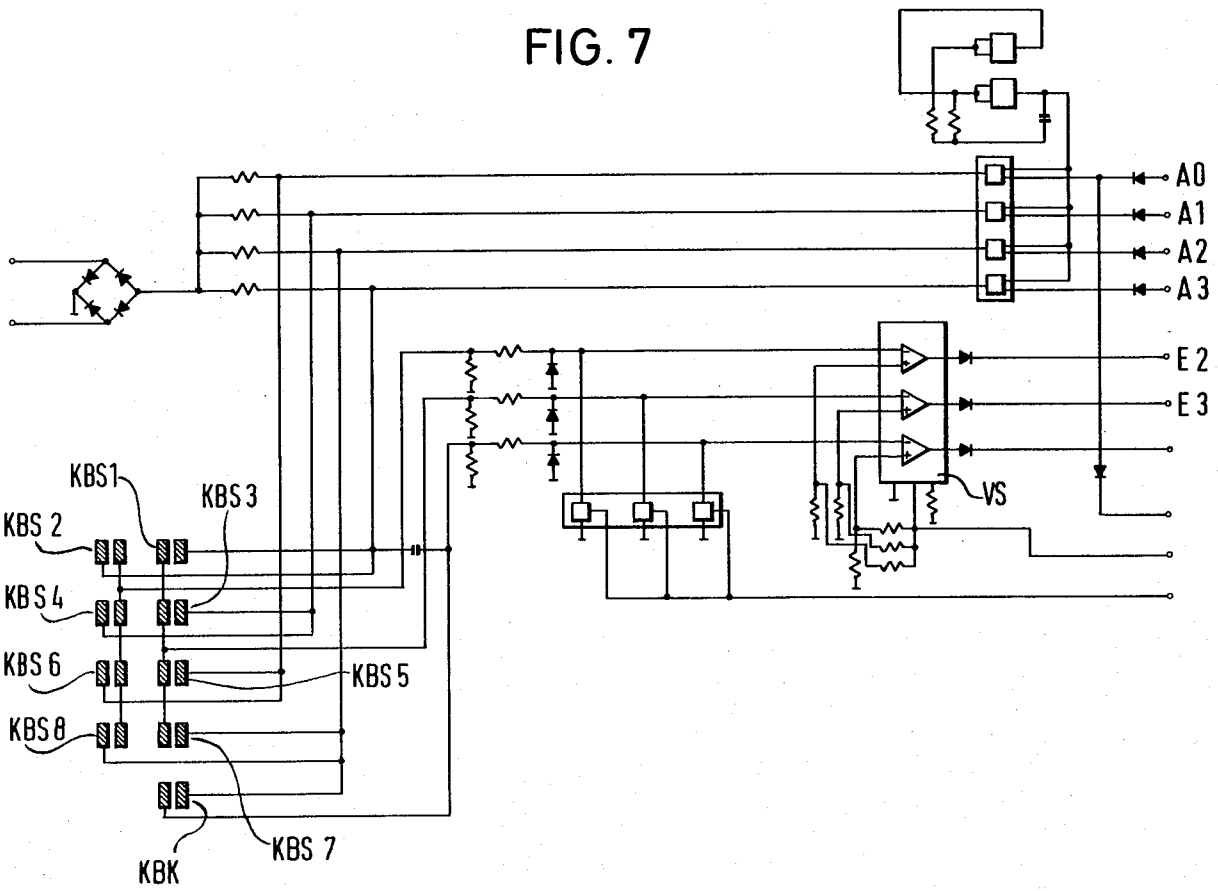
FIG. 7 is a circuit diagram of a part of the switching circuit according to FIG. 5, with input elements responding to touch.
Figure 8:
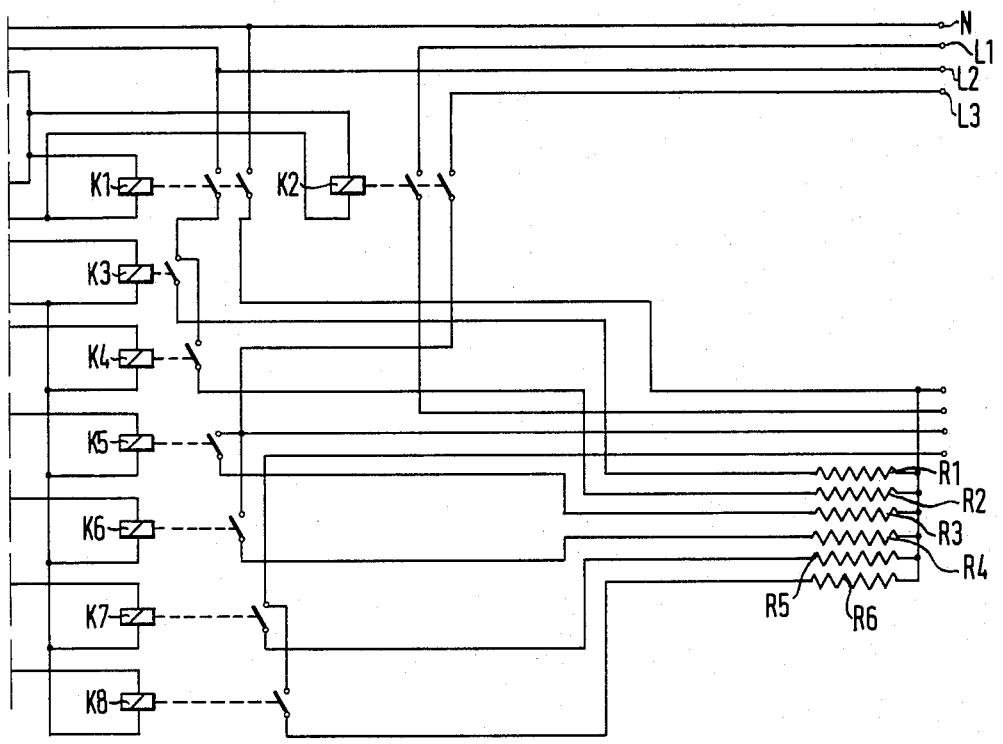
FIG. 8 is a circuit diagram of a relay configuration for conducting heat power current to the individual heating elements.

With respect to FIGS. 5–8, circuit configurations are described for the control of four individual cooking regions and an intermediate cooking zone. It must be understood that FIG. 5 shows a simplified circuit diagram of the entire control circuit of the invention, while FIGS. 6, 7 and 8 are more detailed circuit diagrams of multiplexing, input and relay stages, respectively. Reference should therefore be made to FIG. 5 as FIGS. 6–8 are described, to understand the interconnection of each of the elements.

At the heart of this circuit is a microprocessor $\mu$P. The microprocessor may also be referred to as an electronic control device or a logic circuit connection. Switching means of input elements are connected to the microprocessor at the input side, and indicating elements and relays K1 to K8, for connecting the heating currents for the individual heating regions, are connected to the microprocessor at the output side.

According to FIG. 6, four input switches or switching elements for the four individual cooking regions are disposed at the cooking plate for switching switching contacts or elements S1, S2, S3, S4 to resistor cascades P1, P2, P3, P4 by a rotary motion thereof. Sensors for limiting temperature in the cooking regions may also be connected to the contacts. These resistor cascades, in connection with the switching element, function as variable voltage dividers, which furnish different voltage potentials depending on the position of these switching elements. The combination of switching elements S and resistors P may also be referred to as heating power control devices or power activation control input elements. The outputs of these switching devices are conducted to a multiplexing stage MP. The multiplexing stage MP is directed toward outputs A0, A1, A2, A3, so that the input values of the input switches are interrogated in cyclic succession, and are conducted in sequence to analog inputs E0 and E1 of the microprocessor $\mu$P. Inside the microprocessor, the input values are individually converted to the required power values for the individual heating regions.

In the input circuit according to FIG. 7, capacitative contact switches which serve as touch-sensitive input elements are shown for controlling the power. Two adjacent units KBS1–KBS8 of the capacitative contact switches are always assigned to each of the four individual cooking regions in pairs. Corresponding to the multiplexing stage according to FIG. 6, the capacitative input switches are addressed by the outputs A0–A3 of the microprocessor $\mu$P, and when one of the input-fields is contacted at the point in time of interrogation, a value is put through one of the inputs E2 or E3, which is connected to an amplifier circuit VS. The value corresponds to an increase or a decrease of the set value, respectively.

As seen in FIG. 5, the outputs A0–A3 which are assigned to the individual input elements of the four cooking regions of the cooking plate, are additionally also associated with the corresponding seven-segment-fields of an indicating display AD. Each of these lines controls one of these fields or segments of the display. These numerical indicating displays have seven segments and a decimal point. The selection of these seven segments and the decimal point takes place through parallel outputs PA0–PA7.

The inputs of a latching stage LS are also connected to the outputs PA0–PA7. Through a further output A7 of the microprocessor, the latching stage LS also receives the signal lying at the outputs PA0–PA7, and makes it available at the output side for controlling power switches and switching amplifiers in the form of the relay stage K1–K8. A storing gate circuit which is controlled by the microprocessor is connected to each switching amplifier. Through corresponding timing of these signals generated by the microprocessor, a cycling ratio for the corresponding relays is produced which corresponds to the required current power for the individual heating regions.

Such a relay stage is shown in FIG. 8. This relay stage is formed of eight individual relays of which two relays K1 and K2 conduct phase lines L1, L2, L3 and a neutral conductor N. The remaining relays K3–K8 are assigned to heating elements R1–R6 in the cooking plate. As already described initially herein, four individual cooking regions are provided in this cooking plate. Two of these cooking regions each always contain one heating element R1 and R2. Furthermore, a heating region scheme is privided in the cooking plate, as explained regarding FIGS. 1–4. This makes it necessary to locate four additional individual heating elements R3–R6. The heating resistance element R3 is assigned to the heating area Hb, the heating resistance element R4 to the heating area Ha, the heating resistance element R5 to the intermediate heating region Hz, and the heating resistance element R6 is assigned to the heating region H'b lying in the form of a ring around the heating zone Hb.

By using the input elements described with the aid of FIGS. 6 and 7, the microprocessor control $\mu$P is selectively influenced, causing the respective relays K3, K4, K5, K7, K8 to receive control pulses in the individual cooking mode, so that by using the respectively set pulse-interval ratio, the required heat power is produced through the heating resistance elements R1, R2, R3, R4, R6 in the individual cooking regions. In the individual cooking mode, the two relays K7 and K8 are always controlled together, because they are assigned together to one cooking region.

To provide the cooking mode shown in FIG. 4, wherein the individual region Ha, the individual region Hb, and the intermediate region Hz are used together, it is necessary to give a corresponding input command or criterion. For this purpose, an input element in the form of an input key SK is provided according to FIG. 6, and an input-field KBK is provided according to FIG. 7. The state in which the combination heating mode is switched on, is indicated either by the position of the switch, or by a special indicating element, such as an LED indicator light.

When the input element for the combination mode is operated, the input element for the individual cooking region Ha is activated by the microprocessor control, thereby operating the relays K5, K6, K8, so that the associated heating elements R3, R4, R5 are together supplied with heating current in the same pulse-interval ratio according to the value set by the input element. The relay K7 is not supplied with current in this operating mode. Furthermore, provisions are made for the operation or manipulation of the input element assigned to the individual heating region Hb and H'b to have no effect on the assigned heating region. However, this operation is indicated by a signal display or blinker, for the time period until the combination mode operation and the operation of this input element have been cancelled. A storage stage may be set by the blinker. The combination heating mode is ended by resetting the input element for the heating power control. Therefore, for repeating the combination heating mode, the assigned selection element must be operated again each time.

The specific details concerning several elements of the circuit, such as the switching elements, sensors, storing gate circuits, blinker and storage stage, may be found in co-pending application Ser. No. 465,110 filed concurrently herewith.

The foregoing is a description corresponding to German application P No. 32 04 598.0 dated Feb. 10, 1982, the International priority of which is being claimed for the instant application, and which is hereby made part of this application. Any discrepancies between the foregoing specification and the aforementioned corresponding German application are to be resolved in favor of the latter.

We claim:

1. Control circuit assembly, comprising a cooking plate having at least two individual cooking regions being electrically connectible in common for cooking together, heating elements being disposed in said cooking regions of said cooking plate and having inputs, current circuits connected to said heating elements, an electronic control device connected to said inputs of said heating elements for producing variable heating power outputs, heating power control devices respectively associated with said heating elements, and switching elements disposed in said current circuits for selectively connecting each of said respective heating elements in said individual cooking regions to one of said heating power control devices in a first switching mode, and for connecting said heating elements of said individual cooking regions together to one of said heating power control devices while disconnecting the other heating power control devices for said respective heating elements with which they are associated in a second switching mode.

2. Control circuit assembly according to claim 1, wherein said cooking plate includes an intermediate cooking region disposed between said individual cooking regions, one of said heating elements is disposed in said intermediate cooking region, and in said second switching mode when said heating elements of said individual cooking regions are connected together to said one heating power control device, said heating element of said intermediate cooking region is exclusively connected to a single one of said heating power control devices.

3. Control circuit assembly according to claim 1, wherein at least one of said cooking regions of said cooking plate is in the form of a central heating zone having one of said heating elements disposed therein and a rim heating zone having another of said heating elements disposed therein, said one and other heating elements are controllable together by one of said heating power control devices, and in said second switching mode said heating element of said rim heating zone is disconnected.

4. Control circuit assembly according to claim 1, including individual switching contacts respectively associated with and disposed in series with said heating elements, sensors being connected to said switching contacts and disposed at said heating elements for limiting temperature of said heating elements, said switching contacts being connected in series with said heating elements associated therewith in said second switching mode.

5. Control circuit assembly according to claim 1, wherein in said switching modes when given heating elements are connected to said heating power control devices, said given heating elements are connected to switching elements associated with other heating elements for temperature limiting.

6. Control circuit assembly according to claim 1, wherein said heating power control devices are in the form of power activation control input elements for said individual cooking regions, and including an input element connected to said electronic control device for combined control of a plurality of heating elements, and a respective power switch connected upstream of each of said heating elements, said electronic control device being in the form of a logic circuit connection connected between said control input elements and power switches, for connecting said power switches to a predetermined one of said control input elements and disconnecting the others of said control input elements in said second switching mode, when said input element is operated.

7. Control circuit assembly according to claim 6, wherein said logic circuit connection is a microprocessor circuit having inputs and at least one parallel output terminal, and including a multiplexing circuit being controlled by said microprocessor and connecting together said control input elements for said individual cooking regions to at least one of said inputs of said microprocessor, said input element being connected to one of said inputs of said microprocessor, and switching amplifiers connected between said power switches and said at least one parallel output terminal of said microprocessor.

8. Control circuit assembly according to claim 7, wherein said at least one input of said microprocessor is an analog input, and said control input elements connected to said at least one input are mechanical switches having voltage dividing circuits.

9. Control circuit assembly according to claim 7, wherein said control input elements are touch-sensitive switching units disposed in pairs for each of said individual cooking regions, said microprocessor includes digital inputs assigned to opposing functions, and said switching unit pairs are connected in parallel to said digital inputs of said microprocessor.

10. Control circuit assembly according to claim 7, including indicating displays connected to said parallel outputs of said microprocessor, and storing gate circuits being controlled by said microprocessor and each being respectively associated with one of said switching amplifiers connected to said power switches.

11. Control circuit assembly according to claim 10, including a blinker unit for controlling said indicating display, said blinker unit being assigned to said control input element which is disconnected from said heating elements during said second switching mode, and a storage stage being connected to the circuit assembly when said blinker unit is activated, said storage stage being reset by a corresponding switching input in an off position of said control input element which is disconnected in said second switching mode.

12. Control circuit assembly according to claim 10, including a blinker unit for controlling said indicating display, said blinker unit being assigned to said control input element which is disconnected from said heating elements during said second switching mode, and a storage stage being connected to the circuit assembly when said blinker unit is activated, said storage stage being reset by a corresponding switching input after the end of said second switching mode.

* * * * *